US007726222B2

(12) United States Patent
Endresen

(10) Patent No.: US 7,726,222 B2
(45) Date of Patent: Jun. 1, 2010

(54) ROLLED MEDIA CUTTING DEVICE

(76) Inventor: Kara Endresen, 9841 Prairie Road, Grande Prairie, Alberta (CA) T8V 3Z1

( * ) Notice: Subject to any disclaimer, the term of this patent is extended or adjusted under 35 U.S.C. 154(b) by 481 days.

(21) Appl. No.: 11/758,867

(22) Filed: Jun. 6, 2007

(65) Prior Publication Data

US 2008/0302225 A1 Dec. 11, 2008

(51) Int. Cl.
*B26D 5/00* (2006.01)

(52) U.S. Cl. ..... 83/76.9; 83/408; 83/614

(58) Field of Classification Search ..... 83/76.9, 83/408, 564, 649, 614, 578, 522.11, 455, 83/485

See application file for complete search history.

(56) References Cited

U.S. PATENT DOCUMENTS 3,605,537 A 9/1971 Pickler
3,890,868 A 6/1975 Pickler
3,971,279 A * 7/1976 Wright ..... 83/649
5,025,692 A 6/1991 Reynolds
5,103,710 A 4/1992 Ross
5,367,934 A * 11/1994 MacNiel ..... 83/564
5,894,978 A * 4/1999 Welch et al. ..... 83/408
2005/0000340 A1 1/2005 Petersen
2006/0021485 A1 * 2/2006 Richards ..... 83/614

* cited by examiner

*Primary Examiner*—Stephen Choi
(74) *Attorney, Agent, or Firm*—Maxey Law Offices, PLLC; Stephen Lewellyn

(57) ABSTRACT

A cutting device comprises a support to hold a roll of rolled media, a surface upon which the media is unrolled, and first and second cutting guides, each oriented substantially perpendicular to the media's unrolling path and supporting first and second cutters. The first cutter is movably supported by the first cutting guide and is capable of cutting the rolled media substantially parallel to the unrolling path. The second cutter is movably supported by the second cutting guide and is capable of cutting the rolled media substantially perpendicular to the unrolling path. The cutting device further includes a computing system to calculate the amount of rolled media to be dispensed and how best to cut the rolled media.

8 Claims, 7 Drawing Sheets

ROLLED MEDIA CUTTING DEVICE

FIELD OF THE INVENTION

The present invention relates generally to devices for cutting sheet material. More particularly, relating to devices for cutting sheet material dispensed from a roll to a desired length and width.

BACKGROUND OF THE INVENTION

Media, such as wrapping paper or gift wrap, is often stored in "roll" form. Typically, to dispense rolled media, the roll is placed upon a relatively flat surface and manually unrolled to the desired length. Scissors, or other cutting tools, are then used to cut off a piece of media of the desired width and length.

To assist with the dispensing and cutting of such rolled media, and to stop roll movement, various media handling and cutting devices exist in the art. For example, such types of media handling and cutting devices are described in U.S. Pat. Nos. 490,561; 788,196; 3,605; 3,788,175; 3,821,915; and 5,103,710.

U.S. Pat. No. 5,103,710 to Ross discloses a media handling and cutting device, which is hereby incorporated in entirety by reference. The device of Ross allows the media to be cut to both a desired length and a desired width by employing a cutter that is able to turn perpendicularly. While the cutting device of Ross performs its function as desired, it has a few drawbacks. A first drawback of Ross is that the operator must use the cutter in two operations to cut a piece of media to both a desired length and width. Accordingly and referring to the prior art cutting device of Ross, as diagrammatically shown in FIGS. 1-3: the operator first holds the cutter at a desired "width position" and pulls the media out across the stationary cutter (FIG. 1); next the operator turns the cutter perpendicularly and moves it across the media to cut the media to the desired length (FIGS. 2-3). Another drawback of the device of Ross is that if multiple sheets of media having the same dimensions need to be cut, the operator must pay particular attention at each cutting operation to ensure that the cutter is placed at the proper "width position" prior to each pulling of the media across the cutter.

A device that allows for quick repeated cutting operations of rolled media, to provide sheets of media having both a desired length and width, and which calculates and provides indication of the correct placement of the media cutters is needed.

SUMMARY OF THE INVENTION

In accordance with the present invention, an apparatus for cutting rolled media is provided.

In general, in one aspect, the rolled media cutting device includes:

- a media support means for supporting at least one roll of rolled media;
- a surface upon which the rolled media can be unrolled for movement along a path of travel;
- a frame including a pair of arms pivotally connected at one end to said media support means;
- first and second parallel spaced apart cutting guides extending between said arms in a direction perpendicular to the path of travel of unrolled media on said surface;
- a first cutter slidable on the first cutting guide for cutting the unrolled media in the direction of the path of travel of the media;

- a second cutter slidable on the second cutting guide for cutting the unrolled media perpendicular to the path of travel of the media;
- a securing means for releasably securing said first cutter at a desired width position on said first cutting guide;
- an array of indicators positioned along the length of said first cutting guide;
- a computing means comprising a user input device, said user input device for entering the dimensions of a package to be wrapped by a piece of rolled media; and
- said computing means operably connected to said array of indicators and operating to control at least one indicator to indicate the desired width position of said first cutter based upon the entered package dimensions, thereby aiding a user in the correct placement of the first cutter to facilitate accurate cutting the rolled media.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
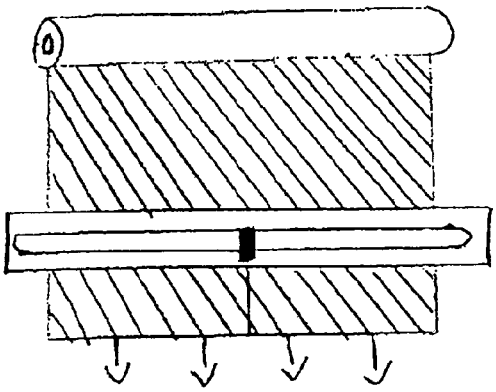
Fig. 1 Prior Art
FIGS. 1-3 are diagrammatic views illustrating the cutting operation of a prior art cutting device.
Figure 2:
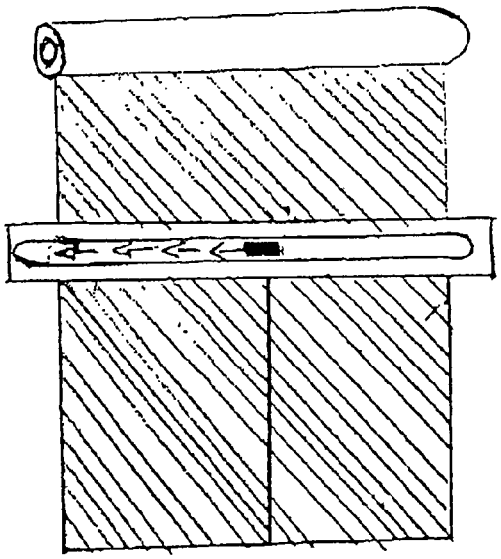
Fig. 2 Prior Art
Figure 3:
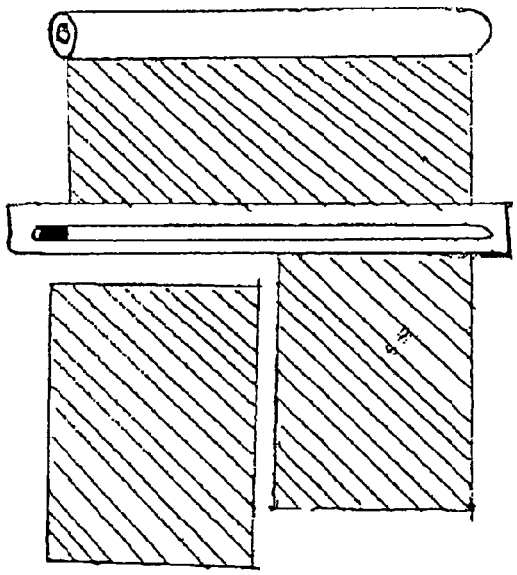
Fig. 3 Prior Art

Referring now to the drawings, and particularly to FIGS. 4-11, a preferred embodiment of the rolled media cutting device of the present invention is shown and generally designated by the reference numeral 10.

Figure 4:
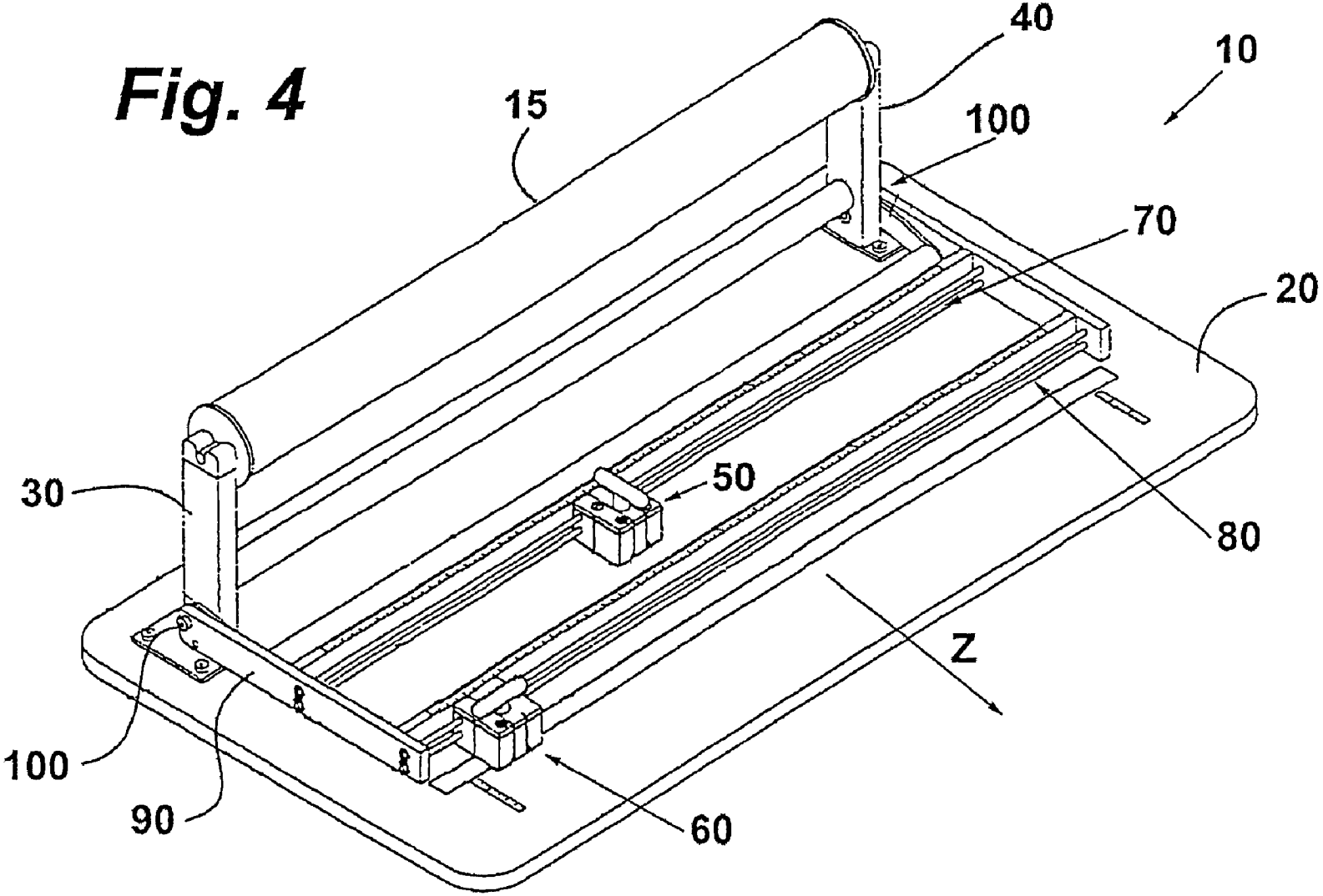
FIG. 4 is a perspective view of rolled media cutting device constructed in accordance with the present invention.

FIG. 4 shows a media cutting device 10 having a dual blade configuration and which supports a roll of media 15, such as gift wrap or wrapping paper, and includes a surface 20 upon which the media 15 is unrolled along path Z. The rolled media 15 is supported on the cutting device 10 by means of two media support columns 30 and 40; although other media support means, which allow for easy unrolling of the media 15 along the path Z, are equally suitable. The cutting device 10 further includes two movable or slidable cutters 50 and 60 supported on cutter guides 70 and 80. The guides 70, 80 are oriented perpendicular to the path Z of the media 15 as it is unrolled across surface 20. In this embodiment, the guides 70 and 80 are separate pieces; however, the guides could also form a single unit without departing from the scope of the invention.

The first cutter 50 is capable of cutting the rolled media 15 substantially parallel to the unrolling path Z, while the second cutter 60 is capable of cutting the rolled media 15 substantially perpendicular to the unrolling path Z. Preferably, the cutters 50 and 60 comprise a circular cutting blade (not shown) although a variety of different types of cutter are known in the prior art which would be equally suitable. Advantageously, the cutters 50 and 60 and the guides 70 and 80 are supported on a frame 90 that is pivotally connected to the base of the media support columns 30 and 40 at pivot points 100 so as to facilitate unrolling the media 15 across the surface 20 prior to cutting.

Figure 5:
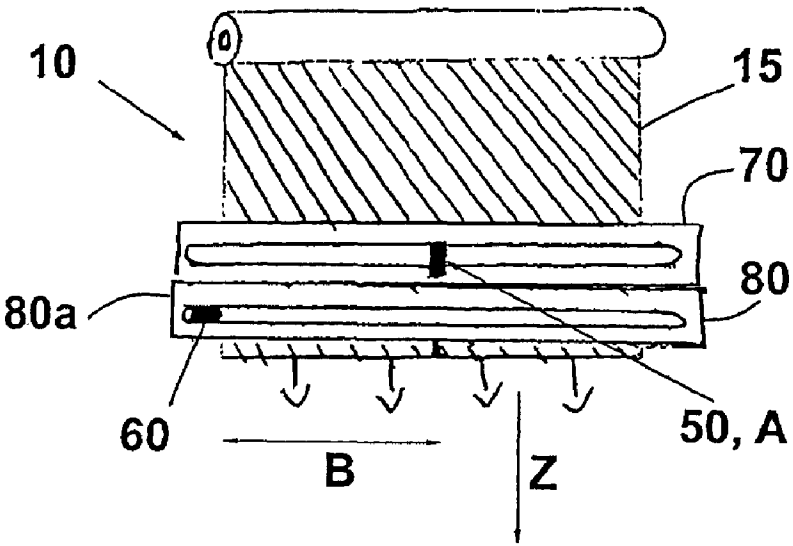

FIG. 5 illustrates the initial steps in the operation of the cutting device 10. For illustrative purposes, only the media 15, the two cutters 50, 60 and the cutter guides 70, 80 are diagrammatically shown. Although the cutters 50, 60 are diagrammatically shown to be within the cutting guides 70, 80 it is understood that a variety of cutter and cutter guide embodiments may be successfully utilized.

To begin the cutting process, the first cutter 50 is releasably secured along the first guide 70 at a desired width location A. The second cutter 60 is placed at a first end 80*a* of the second cutting guide 80. Various devices and methods for releasably securing cutters along a guide are known in the prior art. In this embodiment, frictional forces or a friction fit between the first cutter 50 and the first cutting guide 70 are sufficient during normal cutting operations to retain the cutter 50 at the desired width location A. Advantageously, the first cutter 50 further comprises a screw tightening device (not shown) to releasably secure the cutter 50 at the desired width location A. Such screw tightening devices are well known in the art.

Next, a short portion of the media 15 is unrolled along the path Z and passed by the first cutter 50 and first cutter guides 70 and 80, thereby cutting the media 15 to a desired width B. In this embodiment, the media 15 is passed underneath the cutter guides 70 and 80. However, other designs of cutters and guides may dictate that the media 15 pass through, or even over the top of such cutters and guides. Preferably, the media cutters 50, 60 and the guides 70, 80 are supported on a pivotal frame 90, shown in FIG. 4, so as to assist with the initial unrolling and passing of the media 15 underneath the cutters 50, 60 and guides 70, 80.

Figure 6:
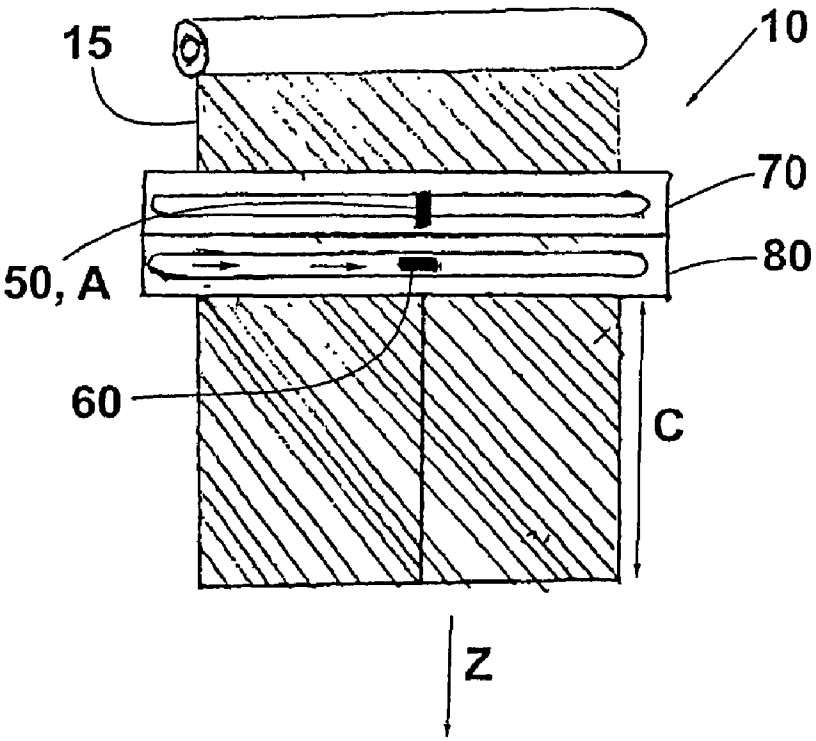
FIGS. 5-8 are diagrammatic views illustrating the cutting operation of the present invention.
Figure 8:
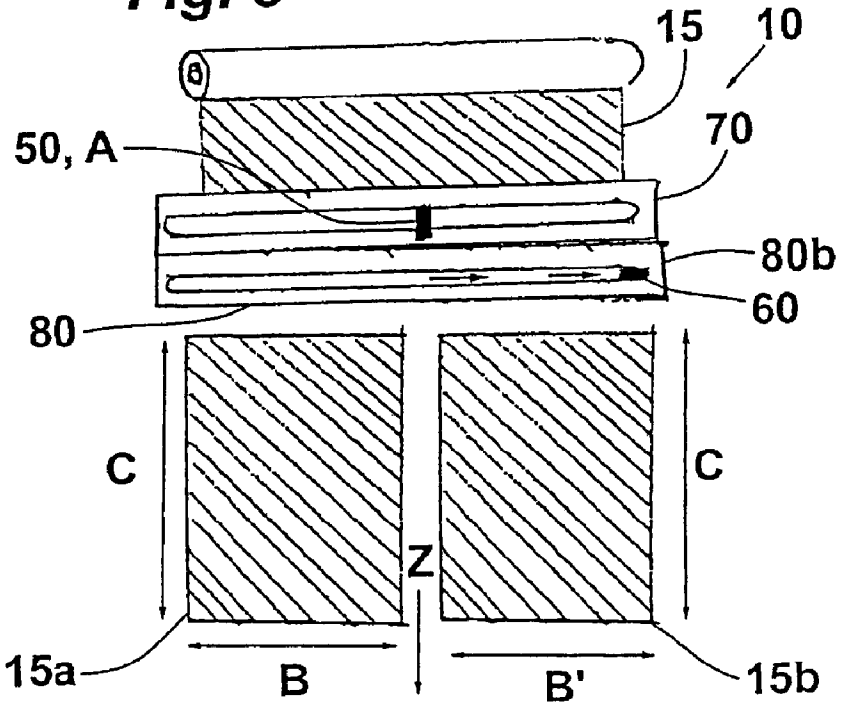
Figure 7:
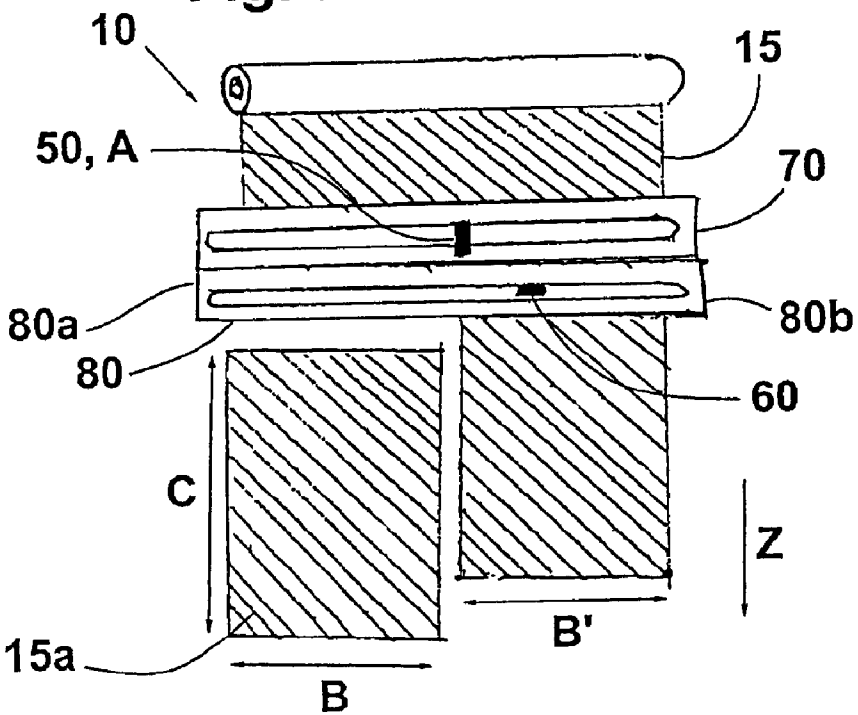

Referring now to FIGS. 6-8, the media 15 is pulled along the path Z until a desired length C is reached. When the desired length C is reached, the second cutter 60 is moved from its location at the first end 80*a* of the second cutter guide 80 to the desired width position A, thereby making a length-wise cut and completely cutting of a piece of media 15*a*, from the rolled media 15, having both a desired length C and a desired width B. Continuing to move the second cutter 60 away from the first end 80*a* completely toward a second end 80*b*, a second piece of media 15*b*, having a desired length C and width cut B' off of the rolled media 15.

Advantageously, the first cutter 50 remains secured at position A while the second cutter 60 can be easily and repeatedly moved between the first end 80*a* and the second end 80*b* as the media 15 is pulled through the device 10 to the desired length C, so as to quickly and efficiently reproduce multiple cut media pieces 15*a*, and 15. As the first cutter 50 remains secured at position A, an operator no longer needs to pay particular attention to returning a cutter to the desired width position A between each length-wise cuts as is the case in the prior art.

Figure 9:
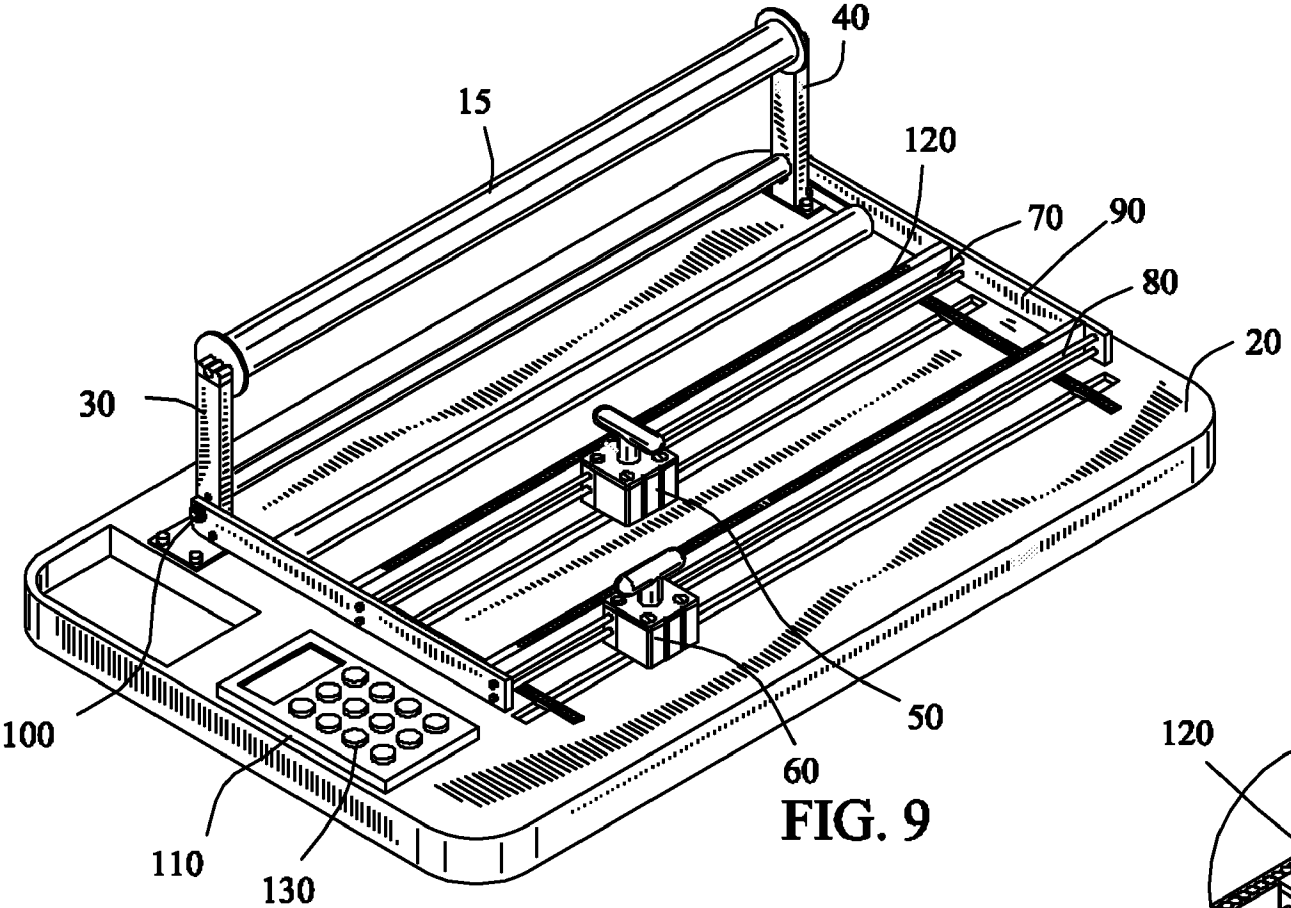
FIG. 9 is a perspective view of the rolled media cutting device including a computing means and cutter positioning indicating means.

With reference to FIG. 9, the cutting device 10 is shown having a computing system 110 and an array of indicators 120, such as light emitting diodes (LED), positioned along the first cutting guide 70. The computing system 110 includes an input device 130, such as a numerical keypad having a display. Using the input device 130, a user can input the length, width and height dimensions of a package to be wrapped by the rolled media 15 into the computing system 110. The computing system 110, using the entered length, width and height dimensions of the package will determine how best to cut the rolled media 15 to reduce waste and maximize usage of the rolled media, this process will be explained in greater detail below.

Figure 10:
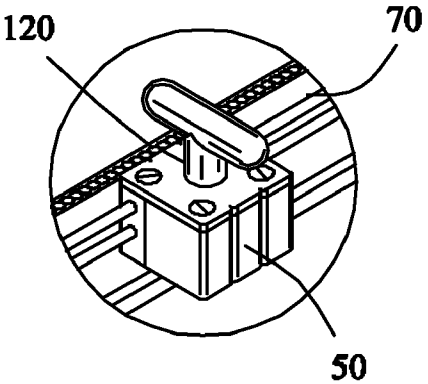
FIG. 10 is an enlarged partial perspective view showing a portion of the cutter positioning indicating means and a cutter.

With particular reference to FIG. 10, once the computing system 110 determines the best mode of cutting the rolled media 15, a single indicator 120 will be illuminated thus indicating the correct positioning of the first cutter 50 as illustrated.

Figure 11:
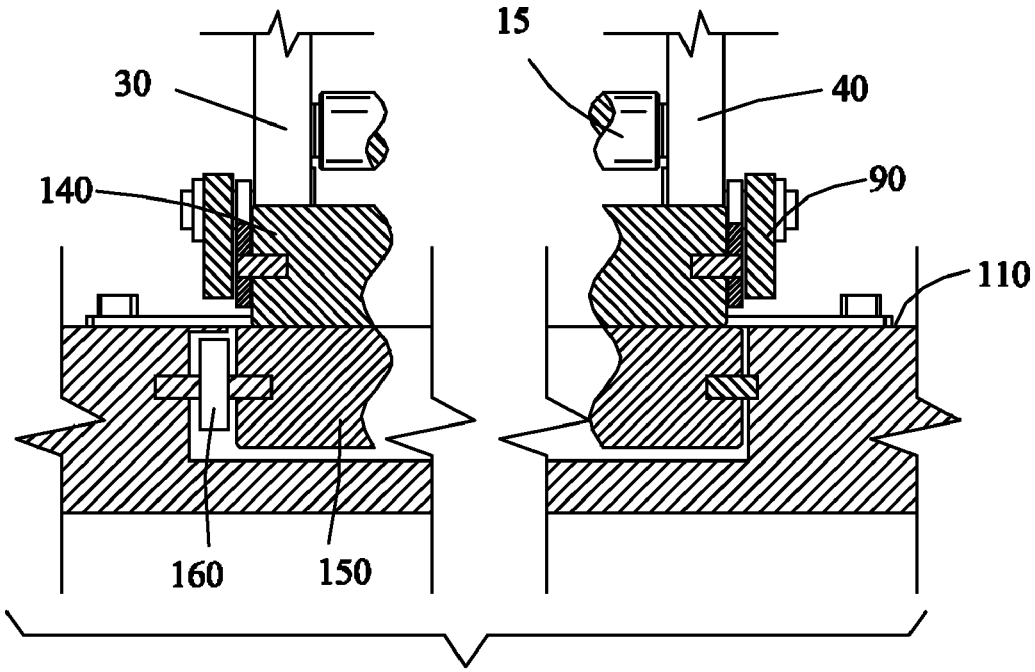
FIG. 11 is a partial cross sectional view taken along line 11-11 in FIG. 9.

Turning now to FIG. 11, the cutting device 10 includes a feed roller 140 secured to the frame 90 and a nip roller 150, which abuts with the feed roller 140. The rolled media 15 is held on a spool supported by the media support columns 30 and 40. In use, the rolled media 15 is feed between the nip roller 150 and the feed roller 140. The feed roller 140 applying a light pressure to the nip roller 150 captures the rolled media 15 as it is pulled along path Z.

Coupled to the nip roller 150 is a feed counter 160 that operates to count the revolutions of the nip roller as the rolled media 15 is dispensed. The feed counter 160 provides a count signal to the computing system 110, which then determines the linear length of rolled media 15 dispensed based on the count of revolutions. The second cutter 60 is at a fixed distance from the axis of rotation of the nip roller 150, with this distance known, the computing system can determine when the correct amount of rolled media 15 is dispensed and indicate this to a user. The indication can be facilitated through the use of visual or audible indicators, such as a light, a buzzer or the like. The indication prompts the user to stop dispensing the rolled media and operate the second cutter 60 to complete the cutting operation.

Figure 12:
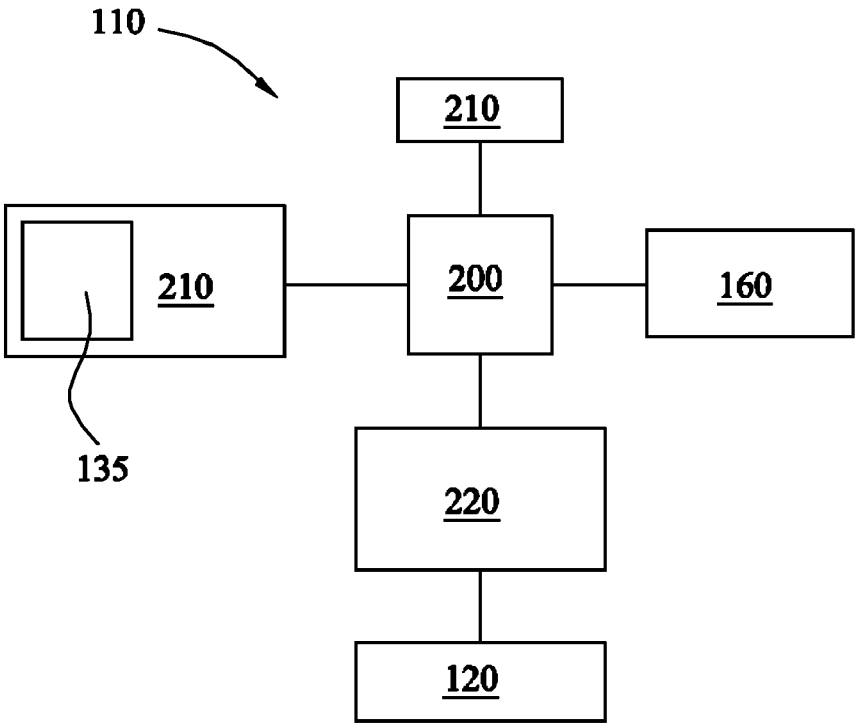
FIG. 12 is a diagrammatic illustration of the computing means.

Turning now to FIG. 12, the computing system 110 includes a PLC 200 to which is connected the input device 130 having a display screen 135, memory 210, the feed counter 160, an LED driving circuit 220, and the array indicators 120.

Figure 13:
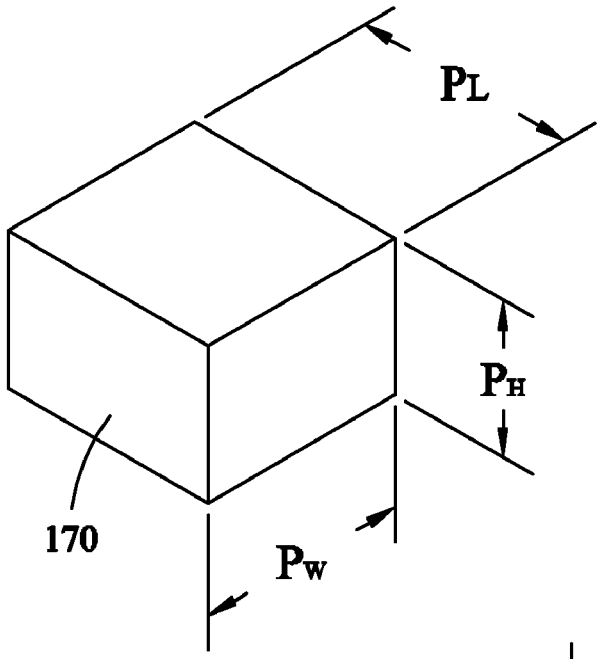
FIG. 13 is a diagrammatic illustration of a package to be wrapped a cut piece of the rolled media using the media cutting device in accordance with the present invention.
Figure 14:
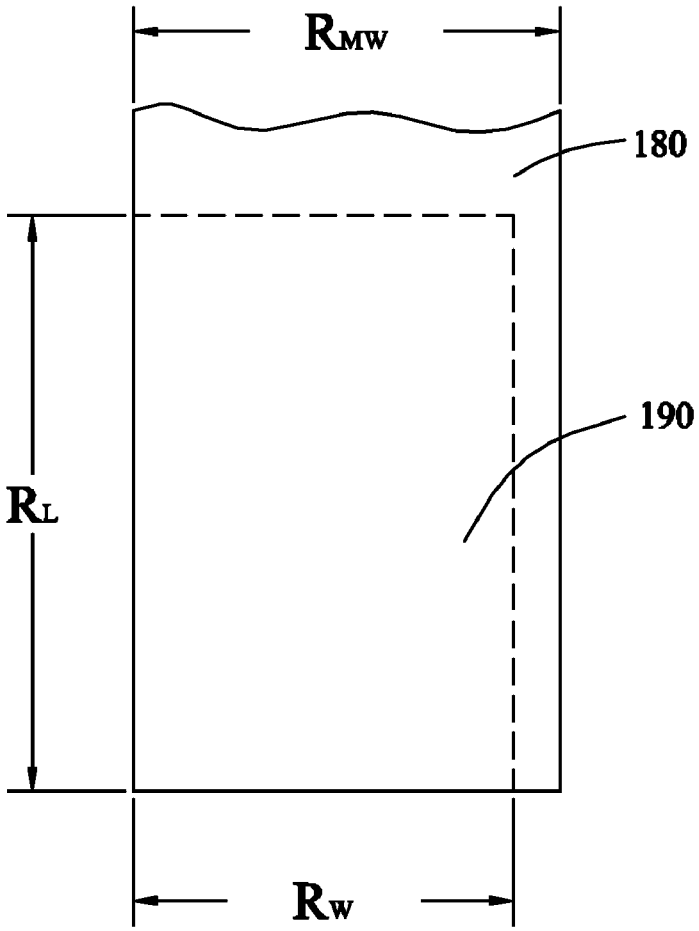
FIG. 14 is a diagrammatic view of section of rolled media having a piece of desired width and length cut therefrom.

With further reference to FIGS. 13 and 14, a more detailed explanation of the computing system 110 and its operation can be had. In FIG. 13 there is illustrated a typical package 170 having dimensions $P_L$, $P_W$ and $P_H$. In FIG. 14 there is shown a section of rolled media 180 having known maximum width $R_{MW}$ and an indeterminate length. A piece of rolled media 190 is cut from the section 180 and has dimensions $R_L$ and $R_W$, this piece of rolled media is cut for the purpose of wrapping the package 170.

In use, a user using the input device 130 would enter the package dimensions $P_L$, $P_W$ and $P_H$ into the computing system 110. The user may also enter a desired overlap dimension $\alpha$ or it could be preprogrammed into the computing system 110. The overlap dimension is the amount of overlap of the rolled media when the package 170 is wrapped by the piece of rolled media 190. It is typical when cutting a piece of media to wrap a package to include a certain extra length to facilitate the wrapping of the package, this is the overlap dimension $\alpha$. Further, the computing system 110 could be preprogrammed with the dimensional width $R_{MW}$ of the section of rolled media.

Once the package dimensions $P_L$, $P_W$ and $P_H$ are inputted into the computing system 110, the computing system calculates a first dimensional length $D_1$, and a second dimensional length $D_2$ as follows:

$$D_1=2\cdot P_W+2\cdot P_H+\alpha$$

$$D_2=2\cdot P_L+2\cdot P_H+\alpha$$

The computing system 110 then determines which dimensional length $D_1$ or $D_2$ should be set to the values of $R_L$ and $R_W$, the dimensions of the piece of rolled media 190 to be cut from the section of rolled media 180. In this determination, $D_1$ and $D_2$ are checked against the maximum width $R_{MW}$ of the section of rolled media 180 to check that both $D_1$ and $D_2$ are not of a value greater then $R_{MW}$, if this were to be the case, an error message would be given to the user indicating that package dimensions are to large for the given section of rolled media. If it is determined that not both $D_1$ and $D_2$ are of a value greater then $R_{MW}$, the computing system 110 determines how to assign dimensional lengths $D_1$ and $D_2$ to dimensions $R_L$ and $R_W$. The following is a logic example that could be used to accomplish the above task:

IF $D_1 > R_{MW}$ and $D_2 > R_{MW}$ THEN error
ELSE IF $D_1 > D_2$ and $D_1 < R_{MW}$ THEN $D_1 = R_w$ and $D_2 = R_L$
ELSE IF $D_2 > D_1$ and $D_2 < R_{MW}$ THEN $D_2 = R_w$ and $D_1 = R_L$ Once the computing system 110 determines the values of $R_W$ and $R_L$, it operates an indicator 120 to notify the user of the correct placement of the first cutter 50 and as the user pulls the rolled media 15 across the cutter, the feed counter 160 provides a count signal to the computing system 110, which then determines the linear length of rolled media 15 dispensed. When the correct length of rolled media 15 is dispensed according to $R_L$, the computing systems operates a single indicator 120 or all of the indictors 120, for example by flashing repeatedly, to alter the user the correct length of rolled media is dispensed. The user would then operate the second cutter 60 to finish cutting the piece of rolled media 190 from the section of rolled media 180.

A number of embodiments of the present invention have been described. Nevertheless, it will be understood that various modifications may be made without departing from the spirit and scope of the invention. Accordingly, other embodiments are within the scope of the following claims.

I claim:

1. A rolled media cutting device, comprising:

a media support means for supporting at least one roll of rolled media;

a surface upon which the rolled media can be unrolled for movement along a path of travel;

a frame including a pair of arms pivotally connected at one end to said media support means;

first and second parallel spaced apart cutting guides extending between said arms in a direction perpendicular to the path of travel of unrolled media on said surface;

a first cutter slidable on the first cutting guide for cutting the unrolled media in the direction of the path of travel of the media;

a second cutter slidable on the second cutting guide for cutting the unrolled media perpendicular to the path of travel of the media;

said first cutter being releasably secured at a desired width position on said first cutting guide by a frictional force between said first cutter and said first cutting guide;

an array of indicators positioned along the length of said first cutting guide;

a computing system comprising a user input device, said user input device for entering the dimensions of a package to be wrapped by a piece of rolled media; and said computing system operably connected to said array of indicators and operating to control at least one indicator to indicate the desired width position of said first cutter based upon the entered package dimensions, thereby aiding a user in the correct placement of the first cutter to facilitate accurate cutting the rolled media.

2. The rolled media cutting device of claim 1, further comprising:

a nip roller positioned such that its axis of rotation is perpendicular to the path of travel of the media;

a feed roller positioned such that its axis of rotation is parallel to that of said nip roller, and such that said nip roller and said feed roller abut; and a feed counter connected to said nip roller for counting the revolutions of said nip roller and generating a count signal which is received by said computing means.

3. The rolled media cutting device of claim 2, wherein said computing system operates to control said array of indicators to signal to a user that a correct amount of rolled media has been dispensed and to operate said second cutter.

4. The rolled media cutting device of claim 3, wherein said frame is pivotal and supports said feed roller.

5. The rolled media cutting device of claim 1, wherein said array of indicators is an array of LEDs.

6. The rolled media cutting device of claim 1, wherein said array indicators are positioned along a top surface of said first cutting guide.

7. A rolled media cutting device comprising:

a media support including upright columns between which at least one roll of media is rotatably supported;

a surface upon which the rolled media can be unrolled for movement along a path of travel;

a frame including a pair of arms, each of said arms pivotally connected at one end to an upright support column;

first and second parallel spaced apart cutting guides extending between said arms in a direction perpendicular to the path of travel of unrolled media on said surface;

a first cutter slidable on the first cutting guide for cutting the unrolled media in the direction of the path of travel of the media;

a second cutter slidable on the second cutting guide for cutting the unrolled media perpendicular to the path of travel of the media;

said first cutter being releasably secured at a desired width position on said first cutting guide by a frictional force between said first cutter and said first cutting guide;

an array of LED indicators positioned along the length of a top surface of said first cutting guide;

a computing system comprising a user input device, said user input device for entering the dimensions of a package to be wrapped by a piece of rolled media;

said computing system operably connected to said array of indicators and operating to control at least one indicator to indicate the desired width position of said first cutter based upon the entered package dimensions, thereby aiding a user in the correct placement of the first cutter to facilitate accurate cutting the rolled media;

a nip roller positioned such that its axis of rotation is perpendicular to the path of travel of the media;

a feed roller positioned such that its axis of rotation is parallel to that of said nip roller, and such that said nip roller and said feed roller abut;

a feed counter connected to said nip roller for counting the revolutions of said nip roller and generating a count signal which is received by said computing means; and said computing system operates to control said array of indicators to signal to a user that a correct amount of rolled media has been dispensed and to operate said second cutter.

8. The rolled media cutting device of claim 7, wherein said frame is pivotal and supports said feed roller.

* * * * *